United States Patent [19]

Connolly

[11] 4,039,257

[45] Aug. 2, 1977

[54] PRETRANSFER COROTRON SWITCHING

[75] Inventor: Douglas P. Connolly, Webster, N.Y.

[73] Assignee: Xerox Corporation, Stamford, Conn.

[21] Appl. No.: 491,895

[22] Filed: July 25, 1974

[51] Int. Cl.[2] ..... G03G 15/16

[52] U.S. Cl. ..... 355/3 R; 96/1 C; 355/14

[58] Field of Search ..... 355/3 R, 14, 3 DD, 3 TR, 355/3 CH; 96/1 C

[56] References Cited

U.S. PATENT DOCUMENTS

| | | | |
|---|---|---|---|
| 3,124,457 | 3/1964 | Schwartz | 96/1 |
| 3,322,098 | 5/1967 | Pegram, Jr. | 355/3 R X |
| 3,778,841 | 12/1973 | Gundlach et al. | 355/3 BE X |
| 3,883,242 | 5/1975 | Takahashi et al. | 355/3 DR |

*Primary Examiner*—L. T. Hix
*Assistant Examiner*—J. A. LaBarre

[57] ABSTRACT

An electrostatographic machine is provided with a manually operable switch for changing the output of a pre-transfer corona discharge device depending upon the contrast characteristic of an original document to be copied. If the pre-transfer device is energized by an A.C. signal biased to a preselected D.C. level, this D.C. bias level may be changed in accordance with contrast quality of the original document to vary the image density at which transition from transfer suppression to transfer enhancement takes place. Alternatively, the A.C. excitation level may be varied to change the point at which transition from transfer enhancement to transfer suppression occurs.

2 Claims, 3 Drawing Figures

PRETRANSFER COROTRON SWITCHING

BACKGROUND OF THE INVENTION

This invention relates to electrostatography, and more particularly to an apparatus for enhancing the transferability of a developed latent image from a photoconductive surface to a receiving member, and for suppressing the transferability of background particles to the receiving member.

In the known practice of xerography, a xerographic surface comprising a layer of photoconductive insulating material affixed to a conductive backing is used to support electrostatic image. In the usual method of carrying out the process, the xerographic surface is electrostatically charged uniformly over its surface and then exposed to a light pattern of the image being reproduced to thereby discharge the charge in the areas where light strikes the layer. The discharged areas of the layer thus form an electrostatic charge pattern in conformity with the configuration of the original light pattern.

The latent electrostatic image may then be developed by contacting it with a finely divided electrostatically attractable material, such as a resinous powder. The powder is held in the image areas by the electrostatic fields on the layer. Where the field is greatest, the largest amoung of material is deposited; and where the field is least, little or no material is deposited. Thus, a powder image is produced in conformity with the light image on the copy being reproduced. The powder is subsequently transferred to a sheet of paper of other surface and suitably affixed to thereby form a permanent print.

The electrostatically attractable developing material commonly used in xerography consists of a pigmented resinous powder referred herein to as "toner" and a coarse granular material called "carrier". The carrier is coated with a material removed in the tribo-electric series from the toner so that a charge is generated between the powder and the granular carrier upon mutual interaction. Such charge causes the powder to adhere to the carrier. The carrier, besides providing a charge to the toner, permits mechanical control so that the toner can readily be brought into contact with the exposed xerographic surface for the development of the surface. The powder particles are attracted to the electrostatic image from the granular material to produce a visible powdered image on the xerographic surface.

A conventional technique for transferring toner from a photosensitive surface to a copy sheet is to move the sheet into synchronous contact with the photoconductive surface while concurrently applying a charge opposite in polarity to the toner to the side of the paper remote from the photoconductive surface. The toner image is thereby attracted from the surface of the photoconductor to the copy sheet. A puff of air may then be employed to separate the image bearing copy paper from the photoconductive surface. The toner image is then fused for the production of the final xerographic copy. This procedure is described in more detail in U.S. Pat. No. 3,062,536.

If negatively charged toner is employed in the system, the transfer corotron is biased positively to deposit a uniform positive charge across one side of the copy paper. With such an arrangement, the negatively charged toner in the image areas of the developed image form areas of high negative charge and are strongly attracted to the copy paper. Background areas of the developed image have only a small amount of toner carried thereby and are only weakly attracted to the copy paper. Even though toner in the background areas is only weakly attracted, some nevertheless is transferred to the copy paper, and this detracts from copy quality.

A method of overcoming this transfer of toner in background areas is disclosed in U.S. Patent application Ser. No. 440,409, assigned to the assignee of this application. In that method, transfer of background toner is inhibited by exposing the photoconductive surface after development, but prior to transfer, to a corona discharge device which neutralizes the negative charge on the toner in background areas while increasing the negative charge on toner in image areas. This method employs an A.C. corotron biased to a positive or negative D.C. potential. The effectiveness of this selective pre-transfer process, is dependent in large measure on the output characteristics of the pre-transfer device, and this in turn must be selected by considering the relative potential of the developed photoconductive surface in the image as opposed to the background areas. That is, if the original to be copied has good contrast, the average density of the toner deposited in image or information bearing areas (and consequently the plate potential) will be high and the output of the pre-transfer corotron may be adjusted to suppress the transfer of all toner densities less than this relatively high value. However, if the original has poor contrast characteristics, the average density of information areas may be significantly lower, such that if the pre-transfer corotrons noted previously is employed, transfer suppression of this toner may take place resulting in a loss of information in the copy.

Thus, when designing a selective pre-transfer corotron for use in a given machine, a compromise must, of necessity, be made so that given the "normal" or "average" original, transferability of image toner is enhanced, while that of background toner is reduced. In such a case, when an original having substantially more or less contrast is copied, less than optimum results are obtained from the selective pre-transfer step.

OBJECTS AND SUMMARY OF THE INVENTION

Therefore, the principal object of this invention is to provide an improved method and apparatus for enhancing the quality of the transferred image.

Another object of this invention is to provide an improved method to minimize the transfer of background particles.

An additional object is the provision of an arrangement for optimizing the transfer of toner by permitting an operator to manually alter the output of a pre-transfer corotron depending on the contrast of the original to be copied.

These and other objects are accomplished by providing a manually operable switch for changing the output of a pre-transfer corona discharge device depending upon the contrast characteristic of an original document to be copied. Since a commonly employed pre-transfer corona discharge device is energized by an A.C. signal biased to a preselected D.C. level, and further since such devices have characteristic curves which may be altered by variation of the D.C. bias level, means are provided to operate the pre-transfer corotron at two distinct D.C. bias levels depending upon the image contrast of the original.

BRIEF DESCRIPTION OF THE DRAWINGS

A better understanding of the present invention as well as other objects and further features thereof will become apparent upon consideration of the following detailed disclosure thereof, especially when taken with the accompanying drawings in which.

DESCRIPTION OF THE PREFERRED EMBODIMENT

Figure 1:
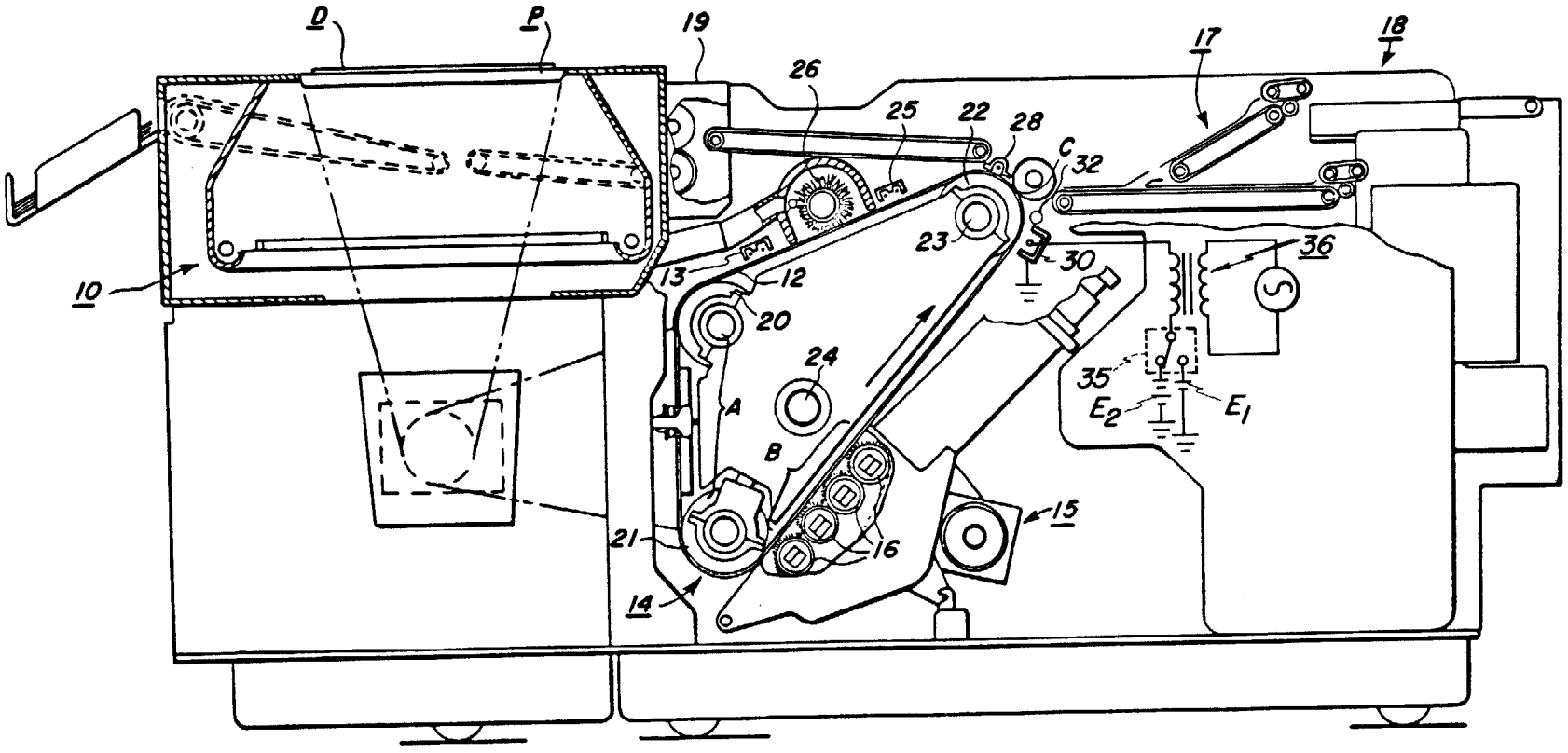
FIG. 1 is an illustrative diagram showing the pre-transfer corotron arrangement of the invention incorporated into an electrophotographic copy machine.

Referring to the drawing, an original document D to be copied is placed upon a transparent support platen P fixedly arranged in an illumination assembly, generally indicated by the reference numeral 10, positioned at the left end of the machine. Light rays from an illumination system are flashed upon the document to produce image rays corresponding to the informational areas. The image rays are projected by means of an optical system onto the photosensitive surface of a xerographic plate in the form of a flexible photoconductive belt 12 arranged on a belt assembly, generally indicated by the reference numeral 14.

The belt 12 comprises a photoconductive layer of selenium which is the light receiving surface and imaging medium for the apparatus, on a conductive backing. The surface of the photoconductive belt is made photosensitive by a previous step of uniformly charging the same from a positive potential source by means of a corona generating device or corotron 13.

The belt is journaled for continuous movement upon three rollers 20, 21 and 22 positioned with their axes in parallel. The photoconductive belt assembly 14 is slidably mounted upon two support shafts 23 and 24 with the roller 22 rotatably supported on the shaft 23 which is secured to the frame of the apparatus and is rotatably driven by a suitable motor and drive assembly (not shown) in the direction of the arrow at a constant rate. During exposure of the belt 12, the portion exposed is that portion of the belt running between rollers 20 and 21. During such movement of the belt 12, the reflected light image of such original document positioned on the platen is flashed on the surface of the belt to produce an electrostatic latent image thereon at exposure station A.

As the belt surface continues its movement, the electrostatic image passes through a developing station B in which there is positioned a developer assembly generally indicated by the reference numeral 15, and which provides development of the electrostatic image by means of multiple brushes 16 as the same moves through the development zone.

The developed electrostatic image is transported by the belt to a transfer station C whereat a sheet of copy paper is moved between a transfer roller and the belt at a speed in synchronism with the moving belt in order to accomplish transfer of the developed image solely by an electrical bias on the transfer roller. There is provided at this station a sheet transport mechanism generally indicated as 17 adapted to transport sheets of paper from a paper handling mechanism generally indicated by the reference numral 18 to the developed image on the belt of the station C.

After the sheet is stripped from the belt 12, it is conveyed into a fuser assembly, generally indicated by the reference numeral 19, wherein the developed and transferred xerographic image on the sheet material is permanently affixed thereto. After fusing, the finished copy is discharged from the apparatus at a suitable point for collection externally of the apparatus.

Further details regarding the structure of the belt assembly 14 and its relationship with the machine and support therefor may be found in the co-pending application Ser. No. 102,312 assigned to the same assignee.

In accordance with the present invention, a pre-transfer corotron 30 is disposed traversely to the photoconductive belt 12 in an electrostatic copying machine at a position between the developer station B and the transfer station C to expose accordingly the photoconductive belt 12 across its width.

The corotron 30 includes a wire connected to one end of the secondary winding of a transformer 36, the other end of the secondary being connected through a single pole double throw switch 35 to either one or two separate DC biasing voltage sources $E_1$ to $E_2$. As shown, the positive sides of the batteries $E_1$ and $E_2$ are connectable to the secondary and the negative sides are grounded. The primary winding of the transformer 36 is connected to an AC source. Thus, it will be appreciated that the corotron 30 is energized by an AC signal which varies about a DC reference level established by either of the batteries $E_1$ or $E_2$.

The switch 35 may be designated as a "light original" switch and mounted for manual operation by the machine operator. It is shown as being internal to the machine in FIG. 1 for purposes of ease of illustration only and most conveniently would be located within easy reach of the machine operator for manual operation.

It is thus seen that the switch 35 permits an an operator to select a DC bias level for the pre-transfer corotron 30. This selection is made in accordance with the contrast quality of the original to be copied to improve the final copy by either enhancing or inhibiting the transfer of background particles.

A brief explanation of the operation of this biasing technique follows, reference being made to copending application Ser. No. 440,409, which also discusses the operation of pretransfer corotron in greater detail.

It is known that transferability of toner may be enhanced by any of three methods (a) by increasing the transferability of the image areas, while maintaining essentially the status quo on the background areas; (b) by suppressing transfer of image while inhibiting transfer of background and (c) by doing (a) and (b) concurrently.

It has been found that the above noted objectives may be accomplished to a greater or lesser extent by exposure of the photoconductor surface after development, but before transfer, to an AC corona discharge (see the above-noted copending application) which operates to concurrently raise the transferability of image areas while lowering the transferability of background areas.

Figure 2:
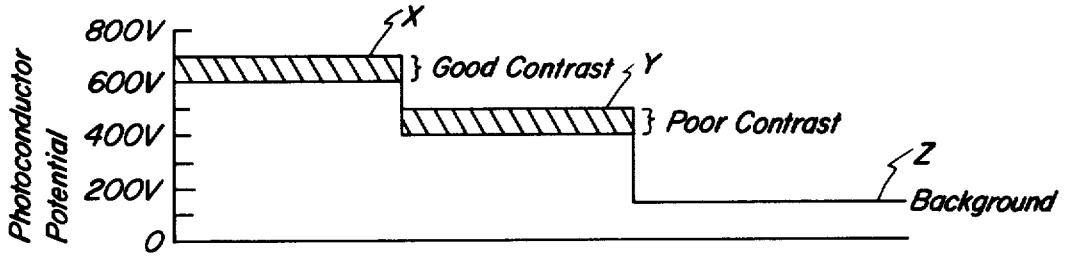
FIG. 2 is a diagram showing typical photoconductor potentials after exposure to an image to be copied for good contrast and poor contrast originals.
Figure 3:
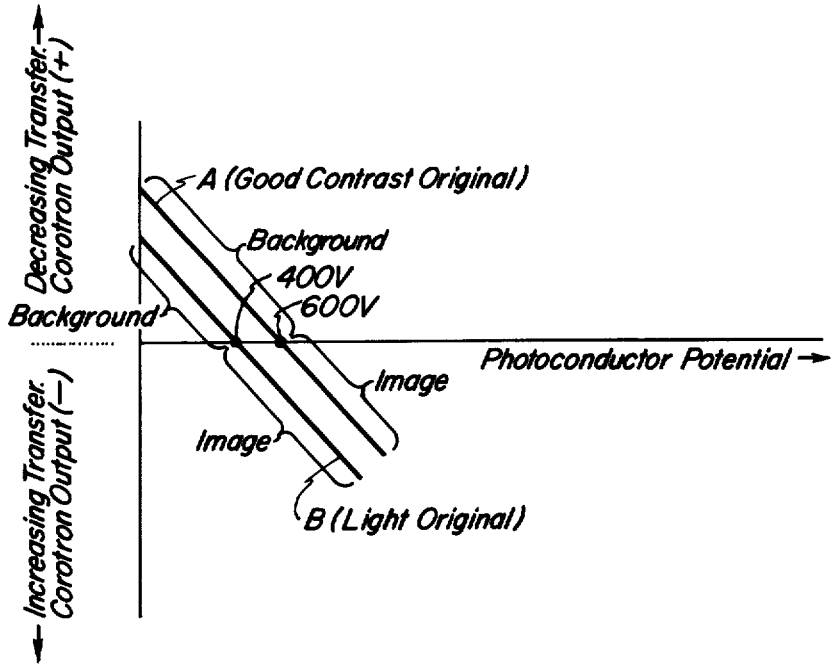
FIG. 3 is a diagram showing the effect of varying the pretransfer corotron D.C. bias level on the photoconductive surface potential.

As a background to understanding this selective pre-transfer principle reference is also made to FIGS. 2 and 3. Prior to exposure to an optical image of the original to be copied, the photoconductor is charged in a manner well known in the art to a high positive uniform surface potential of approximately 700 V. The specific potential is of course a matter of design choice. After exposure, the potentials associated with the image (information) and background areas resulting from good contrast and poor contrast originals are shown in FIG. 2. The band X represents image or information area potentials resulting from good contrast originals, while the band Y represents the typical photoconductor surface potentials associated with image areas on light or poor contrast originals.

It is thus seen that information or image areas from good contrast originals are associated in the system described with post exposure photoconductor surface potentials ranging from say 600 to 700 V, while image areas from poor contrast originals are associated with post exposure photoconductor surface potentials ranging from 400–500 V. (At this point it is noted that the polarities and magnitudes of the potentials discussed above are for illustrative purposes only and the present invention applies equally to systems using different polarity and potential schemes).

Referring again to FIG. 2, the line Z represents the typical photoconductor surface potential associated with background areas and is approximately the same (150 v) for both good and poor contrast originals.

Plotted along the vertical coordinate of the graph of FIG. 3 is the charging current deposited by the corotron as a function of the plate potential of the photoconductive surface, which is plotted on the horizonal coordinate. Thus, the curves A and B indicate in a general manner the amount and character of the charge deposited on elemental areas of the photoconductor passing adjacent an A.C. pretransfer corotron.

In xerographic systems wherein negatively charged toner is used, an increase in positive charge flow from a pretransfer corotron to the photoconductor would tend to reduce the negative charge density of the deposited toner and thus decrease the transferability of toner. Conversely, a negative corona current (deposition of negative ions) would tend to increase the negative toner charge and increase transferability.

Referring back to FIG. 2, it can be seen that in the case of light or poor contrast original, image areas may correspond to photoconductor surface potentials as low as perhaps 400 V, while in the case of good contrast originals image density areas would not correspond to surface potentials below 600 V. Thus, for light originals a pretransfer corotron having a characteristic curve B (ref. to FIG. 3) would be more suitable because it would decrease the transferability of toner associated with photoconductor surface potentials below 400 V (background), while increasing the transferability of toner associated with surface potentials above 400 V, (information).

A pretransfer corotron having an output depicted by curve A, on the other hand, would be more suitable for good contrast originals since it would have the effect of decreasing the transferability of toner associated with surface potentials between 0 and 600 V (background), while increasing the transferability of toner associated with surface potentials above 600 V (information).

As was noted hereinbefore, it has been found that a transformation from Curve A to Curve B may be made in the case of A.C. pretransfer corotrons by varying the D.C. biasing level. Thus, by varying the D.C. level, as shown in FIG. 1, in accordance with the quality of contrast in the original, optimum transferability of toner may be achieved.

The specific values for the energization potentials for a pre-transfer corona device according to the invention would depend, of course, on the particular characteristics of the xerographic system employed, such as the type of photoconductor and the speed at which it is moving. Typical values, however, are 500 volts A.C. with a 1000 volt D.C. bias for curve A of FIG. 3 and 5000 volts A.C. with a 500 volts D.C. bias for curve B.

It is also possible to vary the point of transition from suppression to transfer enhancement by varying the level of the A.C. energization (maintaining the D.C. bias constant) to the pretransfer corona device and such variation is also within the teachings of this invention.

What is claimed is:

1. In an electrostatic reproduction machine having a moving photoconductive surface, a corona discharge device adapted to apply a uniform charge of a predetermined polarity to the surface, means for exposing the charged surface in image-wise configuration for forming an electrostatic image and background areas, a developing means positioned at a development zone for depositing toner on said surface to develop the moving electrostatic image on said surface, and a transfer means to transfer the toner to a receiving member, the combination comprising:

an A.C. corona discharge device positioned between said developing and transfer means for applying corona on said photoconductive surface, said discharge device operating to enhance the transfer of toner associated with photoconductive surface potentials to one side of a transition potential and to suppress the transfer of toner associated with photoconductor potentials to the other side of said transition potential, and means for varying the output of said A.C. corona discharge device between first and second active charge deposition modes, in response to a command from the operator of the machine whereby said discharge device operates to enhance and suppress transfer of toner about first and second transition potentials.

2. The combination recited in claim 1 wherein said means for varying includes a manually operable switching means accessible to a machine operator, and power supply means responsive to the condition of said switch for biasing said device to different D.C. potentials.

* * * * *